US006064357A

United States Patent [19]

Okuda

[11] Patent Number: 6,064,357

[45] Date of Patent: May 16, 2000

[54] DRIVING METHOD AND APPARATUS FOR LIGHT EMITTING DEVICE

[75] Inventor: Yoshiyuki Okuda, Tsurugashima, Japan

[73] Assignee: Pioneer Electrical Corporation, Tokyo, Japan

[21] Appl. No.: 08/725,038

[22] Filed: Oct. 2, 1996

[30] Foreign Application Priority Data

Oct. 4, 1995 [JP] Japan ..... 7-257538

[51] Int. Cl.[7] ..... G09G 3/28

[52] U.S. Cl. ..... 345/82; 345/147; 345/211

[58] Field of Search ..... 345/55, 82, 83, 345/48, 44, 147, 150, 205, 60, 68, 78, 80, 98, 93, 63, 148, 211; 348/803; 315/169.4; 323/349

[56] References Cited

U.S. PATENT DOCUMENTS

| | | | |
|---|---|---|---|
| 3,761,617 | 9/1973 | Tsuchiya et al. | 345/77 |
| 3,906,290 | 9/1975 | Kurahashi et al. | 345/63 |
| 4,006,298 | 2/1977 | Fowler et al. | 315/169.4 |
| 4,194,215 | 3/1980 | Shionoya | 348/803 |
| 4,207,734 | 6/1980 | Moyer | 345/147 |
| 4,654,649 | 3/1987 | Kojima et al. | 345/150 |
| 5,345,167 | 9/1994 | Hasegawa et al. | 323/349 |
| 5,541,618 | 7/1996 | Shinoda | 345/60 |
| 5,619,224 | 4/1997 | Hoshimo et al. | 345/98 |
| 5,708,452 | 1/1998 | Takahashi | 345/55 |

*Primary Examiner*—Dennis-Doon Chow
*Attorney, Agent, or Firm*—Morgan, Lewis & Bockius LLP

[57] ABSTRACT

A driving method and an apparatus for a light emitting device have a simple configuration and activate the device at an accurate luminous intensity. The apparatus includes a power supply which outputs a function of time in synchronization with a timing pulse determining a lighting period, a k-multiplied timing pulse generating part which generates a timing pulse for a period multiplied by 1/k and a control information storing part which stores control information to decide which one of the generated n timing pulses is used. Appropriate pulses generated by said k-multiplied timing generating device are passed based on information stored in said control information storing device and the output from the power supply is sampled using the pulses passed, to activate the light emitting device.

16 Claims, 3 Drawing Sheets

| ADDRESS | |
|---|---|
| 1 | 1 |
| 2 | 0 |
| ⋮ | ⋮ |
| k | 1 |

DRIVING METHOD AND APPARATUS FOR LIGHT EMITTING DEVICE

BACKGROUND OF THE INVENTION

1. Field of the Invention

The present invention relates to driving method and apparatus to a light emitting device.

2. Description of Background Information

Display units using a light emitting device are widely used in electronic devices in recent times. In some cases, a desired display is achieved by changing the luminance of the light emitting device.

Conventionally, the luminance of a light emitting device is changed by using a plurality of power supplies generating different outputs. Among the plurality of outputs from those power supplies, outputs which can be used to produce desired luminance are selected by using switches and resulting outputs are summed to drive a light emitting device.

As described above, in conventional cases, to change the luminance of a light emitting device two or more power supplies are prepared and output values of the power supplies by which a target luminance can be obtained are selectively transmitted to drive the light emitting device.

Therefore, such driving apparatuses are complicated and expensive because of the requirement of a plurality of power supplies. Also, such apparatuses use a number of control signal lines and much time is needed to adjust the output values of the power supplies to specified levels.

OBJECTS AND SUMMARY OF THE INVENTION

It is an object of the present invention to provide a driving method and apparatus for a light emitting device, which are simply configured and are able to produce an accurate luminous intensity.

Measures taken to solve above problems are described below.

According to a first aspect of the present invention, the driving method to activate a light emitting device comprises the steps of producing a function of time in synchronization with lighting timings determining a lighting period of a light emitting device, generating pulses having a period which is 1/k, k being an integer, of the lighting period by 1/k in synchronization with lighting timings, sampling values of the function in the period of the pulses by using the pulses each in the period of the pulses, and driving the light emitting device by using the sampled values of the function, wherein only a combination of the pulses which produces a desired luminance value is outputted to sample values of the function.

According to the second aspect of the present invention, the light emitting device is driven by sampling values of the function the using the pulses having the period of 1/k time of the lighting period and by holding sampled a value sampled at a start time of a sampling for the period of the pulses.

According to the third aspect of the present invention, the function of time generated in synchronization with the lighting timings is a linear function of time.

According to the fourth aspect of the present invention, the function of time generated in synchronization with said lighting timings is a function whose value varies as a power of 2 relative to time.

According to the fifth aspect of the present invention, a combination of pulses producing a designated luminance which corresponds to a luminous area of the light emitting device is used to sample values of the function.

According to the sixth aspect of the present invention, a combination of the pulses used for the sampling is prepared for each of a plurality of light emitting devices and values of the function are sampled by pulses sequentially outputted while being designated as a combination of pulses corresponding to a light emitting device to be driven.

According to the seventh aspect of the present invention, a driving apparatus for driving a light emitting device comprises: a power supply which produces an output as a function of time in synchronization with lighting timing pulses determining a lighting period of the light emitting device, a k-multiplied timing generating device which produces timing pulses having a period multiplied by 1/k, k being an integer, in synchronization with the lighting timing pulses, a control information storing device which stores information to decide which ones of k timing pulses generated by said k-multiplied timing generating device are allowed to be transmitted, a pulse control device which allows timing pulses generated by the k-multiplied timing generating device to pass therethrough based on information stored in the control information storing device, a sampling device for sampling output values of the power supply respectively in the period of the timing pulses using the pulse passed by the pulse control device, and a drive device for driving the light emitting device using the output values sampled by the sampling device.

The power supply produces the output which follows a function of time in synchronization with lighting timing pulses determining a lighting period of the light emitting device.

The said k-multiplied timing generating device produces the timing pulses having a period multiplied by 1/k in synchronization with the lighting timing pulses determining the lighting period.

The control information storing device stores information to decide which ones of the timing pulses produced by the k-multiplied timing generating device are allowed to pass.

The pulse control device allows the selected pulses generated by said k-multiplied timing generating device to pass therethrough based on information stored in the control information storing device.

The sampling device samples the output from the power supply by using each pulse which is allowed to pass through the pulse control device for the period of the pulse, and drives the light emitting device.

According to the eighth aspect of the present invention, the sampling device has a holding device which is used to hold a value sampled at a start time of the sampling for the period of the pulse used for the sampling.

According to the ninth aspect of the present invention, the output generated by said power supply follows a linear function of time.

According to the tenth aspect of the present invention, the output generated by said power supply follows a function whose value varies as a power of 2 relative to time.

According to the eleventh aspect of the present invention, said control information storing device stores control information to decide which ones of the k timing pulses are allowed to pass in accordance with a luminous areas of the light emitting device.

According to the twelfth aspect of the present invention, the control information storing device stores control information pieces for a plurality of light emitting devices and the pulse control device sequentially reads out necessary control information pieces each corresponding to a specified light emitting device to be driven.

As described above, the method and apparatus of a light emitting device is configured to produce a function of time and to sample or hold the value of the function by pulses having a period which is 1/k time of a lighting period, for driving the light emitting device. Only value of the function which produce a desired luminance of the light emitting device are sampled or held, so that the method and apparatus are able to drive the light emitting device at an accurate luminance with a simple configuration which requires only one power supply and only one signal line to control the power supply.

Moreover, by producing a linear function of time or a function whose value varies as a power of 2, the values of many steps can be obtained, so that the luminance of the light emitting device can be changed in a wide range.

In one aspect of the invention, since pulses used for sampling and holding the functional values are selected by using a value weighted by a luminous area, the light emitting device can be activated easily at a desired luminance even if the light emitting device includes light emitting elements having different luminous areas on the display surface.

According to another aspect, a combination of pulses used to sample or hold the values of the function is prepared for each of a plurality of light emitting elements and the values of the function are sampled and held sequentially for the light emitting elements based on the plurality of combination of pulses, thereby a plurality of multiple light emitting elements are driven by a single output, so that the structure of the apparatus can be simplified.

DETAILED DESCRIPTION OF THE PREFERRED EMBODIMENT

An embodiment of the present invention will be described with reference to a block diagram shown in FIG. 1.

Figures 1, 2:
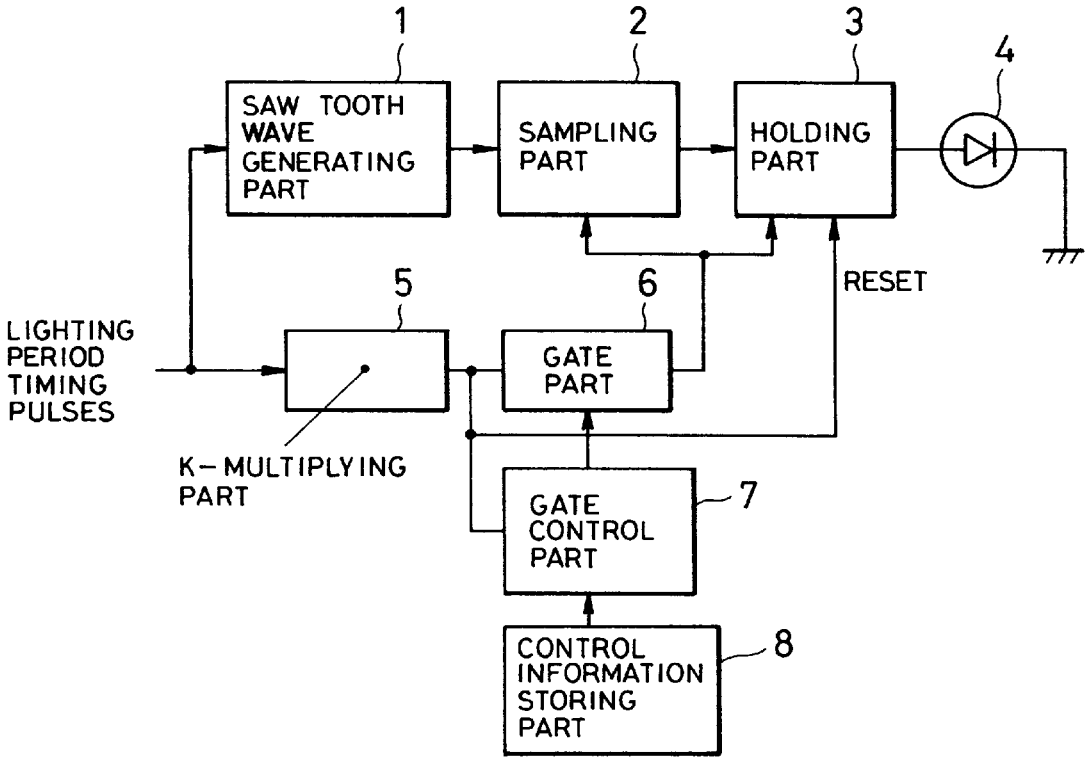
FIG. 1 is a block diagram of showing an embodiment of the light emitting device driving apparatus according to the present invention.
FIG. 2 is a drawing showing exemplification of a control information storing part of the embodiment.

In FIG. 1, the reference numeral 1 denotes a saw tooth wave generating part which generates a saw tooth wave in synchronization with a lighting-period timing pulse. The reference numeral 2 denotes a sampling part to sample an output signal of the saw tooth wave generating part 1, and the reference numeral 3 denotes a holding part to hold a value sampled by the sampling part 2. The reference numeral 4 denotes a light emitting device and the reference numeral 5 denotes a k-multiplying part (a lighting period is multiplied by 1/k) to multiply the lighting-period timing pulse by k. The reference numeral 6 denotes a gate part operative to gate pulses generated by the k-multiplying part 5, and the reference numeral 7 denotes a gate control part to turn on/off the gate part, and the reference numeral 8 being a control information storing part to store information for turning on/off the gate part 6.

When a voltage of $E_1$ is supplied to the light emitting device 4 for one sampling hold section, light is emitted at a luminance proportional to $E_1$ and, if the voltage $E_1$ is supplied for k sections, light is emitted at a luminance proportional to $kE_1$.

In the control information storing part 8, control information is, in advance, stored which corresponds to the luminance at which the light emitting device is to be activated. FIG. 2 shows an example of the control information storing part 8 which has k addresses corresponding to k pulses generated by the k-multiplying part 5. In its memory position corresponding to each address, stored information is configured such that the gate part 6 is turned off with a value "0" and it is turned on with a value "1".

The gate control part 7 includes a modulo-k counter (not shown) which is incremented by one each time that it receives a pulse from the k-multiplying part 5.

When the modulo-k counter is updated, the control information stored in the control information storing part 8 is read out by using the count value of the k counter as an address. If the read value is "0", it turns off the gate part 6. If the read value is "1", it turns on the gate part 6.

Figure 3:
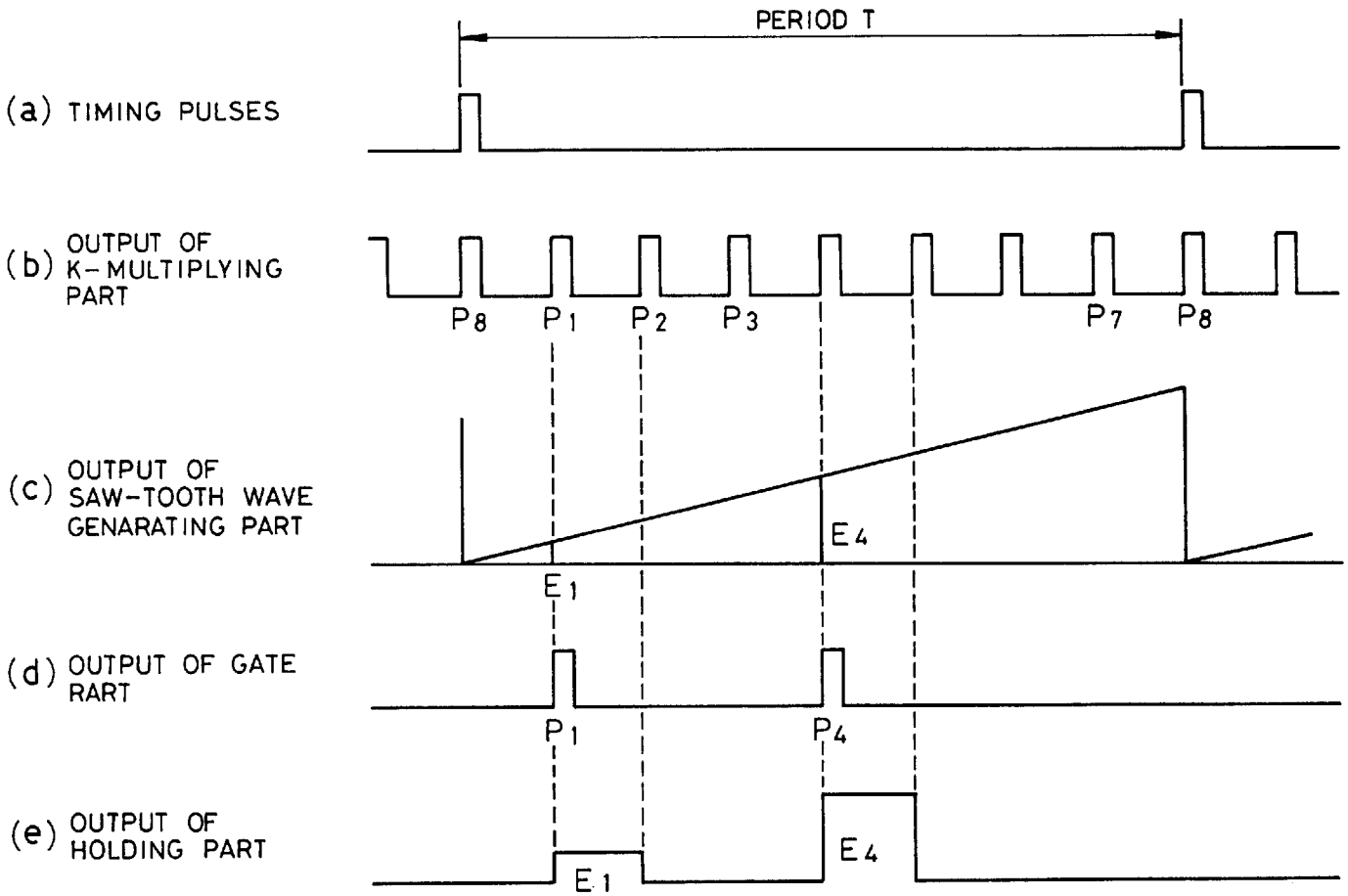
FIG. 3 is a timing chart showing the operation of the embodiment of the present invention.

FIG. 3 is a timing chart for explaining the operation of the apparatus. In FIG. 3, part (a) shows a lighting period timing pulse to be inputted at intervals of T. Part (b) shows output pulses having a period multiplied by 1/k which are generated by the k-multiplying part 5 in synchronization with the timing pulse shown in the part (a). Part (c) shows a saw tooth wave signal generated by the saw tooth wave generating part 1 in synchronization with the timing pulse shown in part (a).

If the information pieces in the first and the fourth addresses of the control information storing part 8 are both "1" and information pieces at other addresses are all "0", pulses $P_1$ and $P_4$ which are outputted from the k-multiplying part 5 are transmitted to the sampling part 2 as shown in part (d). When the $P_1$ pulse is supplied to the sampling part 2, a voltage $E_1$ outputted by the saw tooth wave generating part 1 at a pulse rising time is sampled, and the sampled voltage $E_1$ is held by the holding part 3 as shown in part (e).

The holding part 3 is configured to reset the holding voltage after the voltage is held for one sampling period. Therefore, as shown in FIG. 3, the light emitting device is activated at a luminous intensity which is proportional to $(E_1+E_4)$.

The voltage generated by the saw tooth wave generating part 1 is expressed as $kE_1$ relative to time k. Therefore, when only the pulse $P_1$ is turned on, the voltage $E_1$ is produced. When, on the other hand, all of the pulses $P_1$–$P_k$ are turned on, a voltage k (k+1) $E_1/2$ is produced. When all of the pulses $P_1$ to $P_k$ are turned off, the voltage is equal to 0. By appropriately turning on the pulses $P_1$ to $P_k$, voltages can be outputted with steps of 1+k (k+1)/2.

Other means can be used instead of the saw tooth wave generating part 1. For example, it is possible to use a voltage which increases as a power of 2. In such an example, if the voltage $E_1$ is produced at $P_1$, the voltage is $2E_1$ at $P_2$, and is $2^{k-1}E_1$ at $P_k$. When such a voltage increasing as a power of 2 is generated, the voltage having 2k steps can be produced by the holding part 3.

In the embodiment described above, the light emitting device is driven by holding a value of a function for the period of the pulse at the rising time of the pulse which has passed through the gate part 6. The light emitting device can be alternatively driven by sampling a value of the function for a period of a pulse which has passed through the gate part 6 without the holding process.

In the description given above, the information to be stored in the control information storing part 8 is used to turn on/off the pulse to allow it to pass through the gate part 6 so that an integrated voltage for a lighting period is equal to that corresponding to luminance at which the light emitting device is activated. However, if the luminous area of the light emitting device varies, the desired luminance cannot be obtained. That is, in such a light emitting device as an EL (electroluminescence) panel, unless an integrated voltage being proportional to the luminous area is supplied, a desired luminance cannot be obtained. Therefore, when such a light emitting device having a different luminous area is incorporated, the information is stored in the control information storing part 8 in such a way that an integrated voltage weighted by a luminous area can be obtained.

Furthermore, although the timing pulse for a lighting period is input into the saw tooth wave generating part 1 and the k-multiplying part 5 in the described embodiment, it is also possible to arrange the apparatus that an output of a pulse generating device which can produce a pulse at a period obtained by multiplying a lighting period by 1/k is input into the gate part 1 and the output of a divider which divides the output the pulse generating device by k is input into the saw tooth wave generating part 1.

In the embodiment, voltage values are produced as a function in producing a function relative to time, however, current values can be produced instead of the voltage values.

Moreover, although control information corresponding to one luminous intensity is stored in this embodiment, information corresponding to a plurality of luminous intensities can be stored and an information piece corresponding to a desired luminous intensity can be selectively read out.

Figure 4:
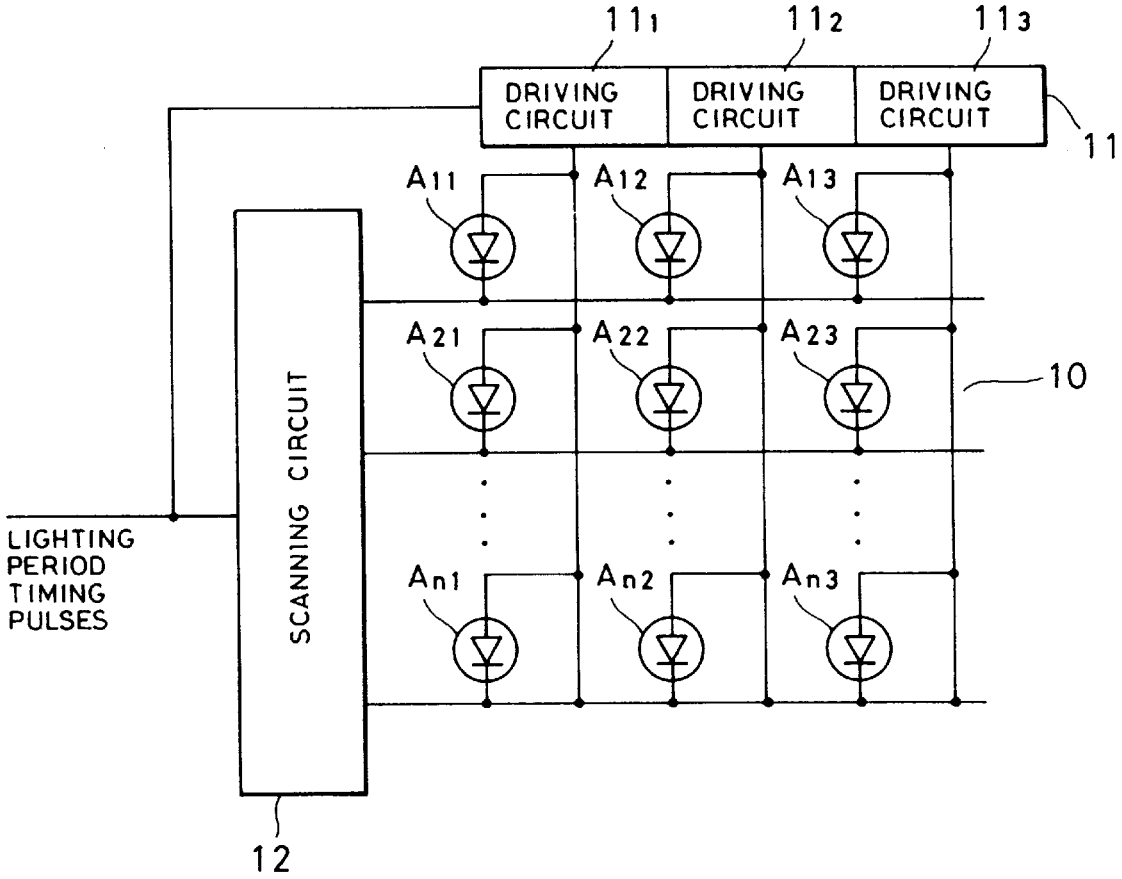
FIG. 4 is a diagram showing an embodiment having a simple matrix type driving scheme.

FIG. 4 shows a configuration wherein a plurality of light emitting devices are activated by a simple matrix type driving arrangement and wherein the reference numeral 10 denotes a light emitting device which consists of 3 columns and n rows of light emitting elements $A_{11}$ to $A_{n3}$. The reference numeral 11 denotes driving circuits ($\mathbf{11}_1$–$\mathbf{11}_3$) common to each column, and the reference numeral 12 denotes a scanning circuit.

Each of the driving circuits ($\mathbf{11}_1$–$\mathbf{11}_3$) are made up of the apparatus depicted in FIG. 1.

The scanning circuit 12 repeatedly connects each of the n lighting lines which are connected to the light emitting device in a sequential order in the period of time T which is one lighting period shown in FIG. 3. When a lighting line is grounded, a current is allowed to flow through the driving circuit 11, thereby activating the light emitting device.

If the shapes and luminous intensities of the light emitting devices $A_{11}$–$A_{1n}$ connected to the first line are identical, the control information to be stored in the control information storing part 8, as shown in FIG. 1 illustrating the driving circuit $\mathbf{11}_1$, can be identical accordingly. However, if the areas and luminous intensities of the light emitting devices are different, all information pieces which correspond to an area and luminance of each light emitting device should be stored and the control information piece corresponding to the light emitting device must be read out for controlling in synchronization with sequential grounding of the n lighting lines performed by the scanning circuit. This allows the n light emitting devices to be activated by using one signal line from the driving circuit and the device to be simply configured even if the area and luminance of the respective light emitting devices are different.

As described above, the following advantageous effects can be obtained by the present invention.

By producing and holding a function of time for a period obtained by multiplying a lighting period by 1/k to activate the light emitting device and only values of the function in selected periods which produce a desired luminance of the light emitting device are sampled or held. By this feature, the apparatus requires only one power supply and only one signal line to control the power supply, so that the light emitting device is driven at an accurate luminous intensity by the apparatus with a simple configuration.

Moreover, by producing a linear function of time or a value which is a power of 2, the luminous intensities of a number of steps can be obtained, thereby changing the luminous intensity of the light emitting device in a wide range.

Furthermore, according to one aspect of the invention, pulses to be used for sampling and holding the functional values are selected by using values weighted according to luminous areas, the light emitting device can be activated easily at a desired luminance even if light emitting elements having different luminous areas are included in the display surface.

By preparing combinations of pulses used to sample or hold the function values which correspond to a plurality of light emitting devices and by sequentially sampling and holding the function values corresponding to the light emitting devices based on the plurality of combinations of the pulses having been prepared, a plurality of light emitting devices can be activated with a simple output, so that the structure of the apparatus can be simplified.

Although the invention has been described in its preferred form, it will be obvious to those skilled in the art that various changes and modifications may be made, and it is intended to cover in the appended claims all such modifications and variations as fall within the spirit and scope of the invention.

What is claimed is:

1. A driving method for driving a light emitting device comprising the steps of:

producing a periodic function of time in synchronization with a lighting timing determining a lighting period of a light emitting device;

generating pulses having a period which is 1/k, k being an integer, of a lighting period in synchronization with the lighting timing;

sampling values of said function by using a combination of pulses selected from among said generated pulses in said lighting period so as to produce a desired luminance value; and driving said light emitting device by using the sampled values of said function.

2. A driving method for driving a light emitting device as claimed in claim 1, wherein a combination of pulses is prepared for each of a plurality of light emitting elements which together constitute said light emitting device, and wherein values of said periodic function are sampled by pulses sequentially output while being designated as a combination of pulses corresponding to a light emitting device to be activated.

3. A driving method for a light emitting device as claimed in claim 2, wherein said light emitting elements are driven by sampling said value of said function using said pulses having the period of 1/k time of said lighting period and by holding a value sampled at a start time of a sampling for said period of said pulses.

4. A driving method for a light emitting device as claimed in claim 3, wherein the function of time to be generated in synchronization with said lighting timings is a linear function of time.

5. A driving method for a light emitting device as claimed in claim 3 wherein said function of time generated in synchronization with said lighting timings is a function whose value varies as a power of 2 relative to time.

6. A driving method for a light emitting device as claimed in claim 2, wherein said function of time generated in synchronization with said lighting timings is a linear function of time.

7. A driving method for a light emitting device as claimed in claim 2, wherein said function of time generated in synchronization with said lighting timings is a function whose value varies as a power of 2 relative to time.

8. A driving method for a light emitting device as claimed in claims 2, wherein a combination of pulses producing a designated luminance which corresponds to a luminous area of said light emitting device is used to sample values of said function.

9. A driving apparatus for driving a light emitting device comprising:

power supply means for producing an output which follows a periodic function of time in synchronization with lighting timing pulses determining a lighting period of said light emitting device;

k-multiplied timing generating means for producing timing pulses having a period multiplied by 1/k, k being an integer, in synchronization with said lighting timing pulses;

control information storing means for storing information indicating a combination of pulses selected from among k timing pulses generated by said k-multiplied timing generating means, which are allowed to be transmitted;

pulse control means which allows timing pulses generated by said k-multiplied timing generating means to pass therethrough based on information stored in said control information storing device;

sampling means for sampling output values of said power supply means respectively in the period of the timing pulses using the pulses passed by said pulse control means; and driving means for driving said light emitting device using said output values sampled by said sampling means.

10. A driving apparatus for a light emitting device as claimed in claim 9, wherein control information pieces for a plurality of light emitting elements which together constitute said light emitting device are stored in said control information storing means and a control information piece corresponding to a light emitting element to be driven is in turn read out from said control information storing means, for a control operation.

11. A driving apparatus for a light emitting device as claimed in claim 10, wherein said sampling means includes a holding means for holding a sampled value sampled at a start time of the sampling for the period of the timing pulses, to drive said light emitting device.

12. A driving apparatus for a light emitting device as claimed in claim 11, wherein said output generated by said power supply follows a linear function of time.

13. A driving apparatus for a light emitting device as claimed in claim 11, wherein said output generated by said power supply follows a function of time whose value varies as a power of 2 relative to time.

14. A driving apparatus for a light emitting device as claimed in claim 10, wherein said output generated by said power supply follows as a linear function of time.

15. A driving apparatus for a light emitting device as claimed in claim 10, wherein said output generated by said power supply follows a function of time whose value varies as a power of 2 relative to time.

16. A driving apparatus for a light emitting device as claimed in claim 10, wherein said control information stored in said control information storing means indicates which ones of the k timing pulses numbering k are allowed to pass in accordance with a luminous area of said light emitting device.

* * * * *